US011780059B2

(12) United States Patent
Milligan et al.

(10) Patent No.: US 11,780,059 B2
(45) Date of Patent: Oct. 10, 2023

(54) SOCKET WRENCH OPENING

(71) Applicant: Wright Tool Company, Barberton, OH (US)

(72) Inventors: Kenneth R. Milligan, Uniontown, OH (US); Terry G. Taylor, Copley, OH (US)

(73) Assignee: Wright Tool Company, Barberton, OH (US)

( * ) Notice: Subject to any disclaimer, the term of this patent is extended or adjusted under 35 U.S.C. 154(b) by 0 days.

(21) Appl. No.: 16/750,283

(22) Filed: Jan. 23, 2020

(65) Prior Publication Data

US 2020/0230786 A1 Jul. 23, 2020

Related U.S. Application Data

(60) Provisional application No. 62/958,761, filed on Jan. 9, 2020, provisional application No. 62/795,639, filed on Jan. 23, 2019.

(51) Int. Cl.

| | |
|---|---|
| ***B25B 13/06*** | (2006.01) |
| *B25B 21/00* | (2006.01) |
| *B25B 23/00* | (2006.01) |

(52) U.S. Cl.

CPC ..... *B25B 13/065* (2013.01); *B25B 21/00* (2013.01); *B25B 23/0035* (2013.01)

(58) Field of Classification Search

CPC ..... B25B 13/06; B25B 13/065
USPC ..... 81/121.1
See application file for complete search history.

(56) References Cited

U.S. PATENT DOCUMENTS

| | | | |
|---|---|---|---|
| 2,777,353 | A | 1/1957 | Willis |
| 3,079,819 | A | 3/1963 | Wing |
| 3,125,910 | A | 3/1964 | Kavalar |
| 3,242,775 | A | 3/1966 | Hinkle |
| 3,273,430 | A | 9/1966 | Knudsen et al. |
| 3,354,747 | A | 11/1967 | Grimm et al. |
| 3,466,956 | A | 9/1969 | Bowers |
| 3,495,485 | A | 2/1970 | Knudsen et al. |
| 3,675,516 | A | 7/1972 | Knudsen et al. |
| 3,885,480 | A | 9/1975 | Andersen |
| 3,908,488 | A | 9/1975 | Andersen |
| 4,010,670 | A | 3/1977 | Lejdegard |
| 4,100,824 | A | 7/1978 | Marschke |

(Continued)

FOREIGN PATENT DOCUMENTS

| | | |
|---|---|---|
| IT | 602687 | 3/1960 |

*Primary Examiner* — Brian D Keller
*Assistant Examiner* — Robert C Moore
(74) *Attorney, Agent, or Firm* — Dinsmore & Shohl LLP; Sean Mellino

(57) ABSTRACT

A fully parametric profile for improved tooling in a tool/fastener system is provided that details a profile from a single proved Wright number, and that improves the contact area across a full spectrum of industry standard tolerances, while preserving safe pockets for fastener corners, thereby providing for increased tool life. The tool profile is based on a central axis and a parametric set of coordinates for flats, transition points, and multiple radii. The profile mates selectively with a set of fasteners having a central axis and a plurality of flat bounding surfaces parallel to the fastener access wherein diametrically opposite pairs of surfaces are parallel to each other and the bounding surfaces intersect in adjacent pairs to form fastener corners.

6 Claims, 17 Drawing Sheets

(56) References Cited

U.S. PATENT DOCUMENTS

| | | | | | |
|---|---|---|---|---|---|
| 4,361,412 | A | | 11/1982 | Stolarczyk | |
| 4,512,220 | A | | 4/1985 | Barnhill, III et al. | |
| 4,581,957 | A | * | 4/1986 | Dossier | B25B 13/065 81/121.1 |
| 4,598,616 | A | | 7/1986 | Colvin | |
| 4,882,957 | A | | 11/1989 | Wright et al. | |
| 4,930,378 | A | * | 6/1990 | Colvin | B25B 13/065 81/121.1 |
| 5,012,706 | A | | 5/1991 | Wright et al. | |
| 5,082,125 | A | | 1/1992 | Ninni | |
| 5,092,203 | A | | 3/1992 | Mader et al. | |
| 5,284,073 | A | * | 2/1994 | Wright | B25B 13/065 81/186 |
| 5,406,868 | A | | 4/1995 | Foster | |
| 5,481,948 | A | * | 1/1996 | Zerkovitz | B25B 15/008 81/436 |
| D372,409 | S | | 8/1996 | Wright et al. | |
| 5,904,077 | A | | 5/1999 | Wright et al. | |
| D451,352 | S | | 12/2001 | Wright | |
| 6,354,175 | B1 | | 3/2002 | Dobson et al. | |
| D476,868 | S | | 7/2003 | Wright et al. | |
| 6,698,315 | B1 | | 3/2004 | Wright | |
| 6,725,746 | B1 | | 4/2004 | Wright | |
| 6,904,833 | B2 | | 6/2005 | Wright | |
| 6,907,805 | B2 | | 6/2005 | Wright et al. | |
| 7,174,811 | B2 | | 2/2007 | Wright | |
| 7,340,982 | B2 | | 3/2008 | Wright et al. | |
| 7,484,440 | B2 | | 2/2009 | Wright | |
| 7,661,339 | B2 | | 2/2010 | Wu | |
| 7,788,994 | B2 | | 9/2010 | Wright et al. | |
| 7,841,261 | B2 | | 11/2010 | Milligan et al. | |
| 9,718,170 | B2 | | 8/2017 | Eggert et al. | |
| 10,442,059 | B2 | | 10/2019 | Milligan et al. | |
| 2010/0011915 | A1 | * | 1/2010 | Badger | B25G 1/005 81/60 |
| 2014/0196578 | A1 | | 7/2014 | Milligan et al. | |
| 2019/0134787 | A1 | | 5/2019 | Milligan et al. | |

* cited by examiner

SOCKET WRENCH OPENING

CROSS-REFERENCE TO RELATED APPLICATION

This application claims the benefit of and/or priority to U.S. Provisional Patent Application No. 62/795,639 filed on Jan. 23, 2019 and U.S. Provisional Patent Application No. 62/958,761 filed on Jan. 9, 2020, the entireties of which are incorporated herein by reference.

FIELD OF THE INVENTION

The innovation disclosed herein relates to an improved tool profile of a tool for use in a tool/fastener system. More specifically, the present innovation relates to improving the contact zone of a tool while maintaining a clearance for fastener corners, which provides better tool protection than that presently available.

BACKGROUND

The art has long recognized that the world is not a perfect place, and that in the normal course of using fasteners, variations in both tool and fastener may lead to wear and other unfavorable conditions. Most often, the main focal point of innovations aimed at improving these conditions are directed to effects as may be seen on fasteners, such as, for example, providing a tool with "safe pockets" to avoid engaging the corners of fasteners. Thus, often primary attempts at innovation are to preserve the integrity of the fastener, and it may be only subsequent attention, and only indirect focus, that may be directed to innovation concerning aspects of a tool that performs the fastening.

As is to be appreciated, fastener corners may present point contacts in an operation of fastening, and if contacted, may wear and damage a fastener, such as for example a fastener being rounded. In other fastener settings, the obverse may be true. For example, counter-sunk screws present a fastener with a contact area that may be considered to be an obverse mirror of a hex head screw. Improper tool use may create a situation in which a proper standard tool no longer makes the appropriate contact as it was designed to do. In fasteners of a counter-sunk screw type, the "rounding" that occurs evidences itself in the corner areas of the fastener being worn away, typically in a radial manner, as an improper tool (typically undersized) cannot have enough force to rotate the screw, and instead slips in place, rotating around the central axis of the tool. Of course, the usefulness of the analogy may stop there, as the single radius at the central axis of the tool is not particularly useful in an obverse setting. There are various methods of removing such stripped counter sunk fasteners which may utilize a number of concepts to have force apply as initially designed even as the features of the fastener may no longer exist for normal use. Improving the zone of contact is such an approach.

Prior attempts at innovation have focused on one or more profile elements of a mating profile between the tool and fastener. Other innovations, of course, are possible, as none of these innovations on their own pre-empt the idea of making a better fastening tool/fastener system, or even pre-empt all mating contours of a fastener/fastening tool system. A concept that may be redirected in a novel manner from an obverse condition is exemplified in the disclosed innovation. That concept recognizes that real world effects are unavoidable. That concept also realizes that many attempts at innovation still focus on the fastener wear as a first consideration. That concept instead approaches innovation by focusing on improvements with the tool. Additionally, it is to be appreciated from the provided disclosure, that the concept of the innovation provides an emphasis on full parametrization.

Some prior art exists that also focus on the tool, albeit in different aspects such as considerations of manufacturing costs of the tool. For example, U.S. Pat. No. 6,354,175 to Dobson et al., teaches the use of a concave and convex pair of radii in forming a profile. This innovation is related to improving manufacturing costs, and emphasizes holding both radii to be equal. As only some of the profile features are taught to be in proportion, the profile is only semi-parametric.

Another aspect wherein a tool has a more primary focus is displayed in tools that may be utilized for fastener placement in limited space zones. Advances of this sort tend to deal with improvements of the material of the tool. Other improvements may be directed to multiple aspects, for example, US Publication No. 2003/0126960 to Chen, A., features both convex and concave portions, but emphasizes a uniform thickness of a peripheral wall of the tool in order to minimize tool stress, with a view that changing tool thickness is to be avoided.

Many innovations in this area may include a sense of "real world" by including in their considerations that tolerances exist (and have been set up as standards in the art). Another aspect of the disclosed innovation is to treat these tolerances not only as development guidelines of the relative sizes of parts making up the tool/fastener system, but to also take into account how mismatches in tolerances (for example, high side tolerance on a tool mated with low side tolerance of a fastener) impact the tool side of the tool/fastener system. Innovation is achieved with this different focusing. Prior innovation, as may be evidenced in patent U.S. Pat. No. 5,284,073 to Wright, et al., (which is commonly owned) has addressed portions of innovative aspects that are more fully brought to bear in the disclosed innovation herein. For example, an innovation as exemplified in the commercially available Wright Drive 1.0, provides a focus on the landing contact area of the tool in the tool/fastener system. In that system, point contact (no matter where the point contact may be on a fastener, and no matter how a corner of a fastener may be protected in a tool by providing a tool with "pocket recesses") is modified to provide a zone of contact.

U.S. Pat. No. 5,092,203 to Mader is similar in that a flank angle is interposed adjacent to a mid-flat region in view of tolerances that may exist. As may be gleaned from the Mader reference, a lack of parametrization leads to different performance for different sized fasteners. The solution pursued in Mader was to introduce an additional flat zone; partially parametric (in a compounded fashion) by way of a flank angle as a function of tolerances related to both separate fastener size and of fastening tool.

It is to be appreciated that even with employing convex and concave profiling, innovation may distinguish from, and between, prior art. Prior art exists that may employ convex and concave profiling for a tool's mating surface that is intended to engage a fastener. While this may be so, it is to be appreciated that innovation may aim for different effects, such as for example constant wall thickness with a more sinusoidal profiling (as discussed above), and teaches a different innovative aim. Alternative items of prior art have tended to focus on modifying a pure sinusoidal profiling for different effects or purposes. For example, U.S. Pat. No. 5,406,868 to Foster teaches to different offsets of placement of convex and concave profile portions. Foster teaches limitations as found in U.S. Pat. No. 4,930,378 to Colvin (herein Colvin '378), that include induced stress risers at profile points of intersecting flats and arcs. Foster introduces a factor "S" that is not parametric to the profile. Other profiles may exist of course for other purposes. Colvin '378 provides a profile with a radial element interposed between a face flat and a flank angle flat. However, Colvin '378 teaches this radial portion to be variable (and not parametrized) along a "Z" dimension of a fastening tool.

For another example, U.S. Pat. No. 7,661,339 to Wu includes notches that may serve to engage a fastener surface in conditions in which a fastener may slip from its original placement (for example, due to a rounded condition of a fastener). While sharing a general notion of convex and concave curvatures, this innovation sets out a different selected profile to achieve an innovative improvement in a different manner.

U.S. Pat. No. 9,718,170 to Eggert et al., shows subtle innovation. Similar to Wright and Mader, Eggert teaches to an additional angled flat zone along with a radiused "safe zone" for fastener corner clearance. The innovation in Eggert appears to be based on positioning the inclined flat zone of the profile by varying a degree of rotation apart from any tolerance consideration. (See Col. 4, Lines 1-26 therein.)

SUMMARY OF THE PRESENT INVENTION

Additional innovation in enlarging the contact zone between tool and fastener (while, for example, maintaining a safe "pocket" clearance for fastener corners) is obtained by the present disclosure. By focusing on mating from more than nominal tolerances, taking insight into expanding a zone of contact, and developing the innovation to be scalable (that is, fully parametric), many advantages over the conventional state of the art are achieved.

It is an object of the present invention to provide a multi-sided drive for hexagonal fasteners having drive surfaces which are parametrically designated so as to improve a contact area between a tool and a fastener during driving over a full range of expected standard tolerances.

It is another object of the present invention to provide a multi-sided drive as described above which eliminates sharp arcuate angles in the fastener corner clearance recess, and which are likewise parametrically designated.

It is another object of the present invention to provide a multi-sided drive as described above which reduces and more uniformly distributes the internal stress that is exerted on the socket during driving due to the selected parametric profile.

Another object of the present invention is to provide a multi-sided drive as described above having a shape which lends itself to efficient reproduction and which facilitates longer forging punch life due to the selected parametric profile having as its basis, a prior innovation commonly owned.

These and other objects and advantages will become apparent from the following description of a preferred embodiment of the invention taken together with the accompanying drawings.

BRIEF DESCRIPTION OF THE DRAWINGS

Reference is made it to the following drawings, which are summarized as follows.

DETAILED DESCRIPTION OF THE PREFERRED EMBODIMENT

Figure 1:
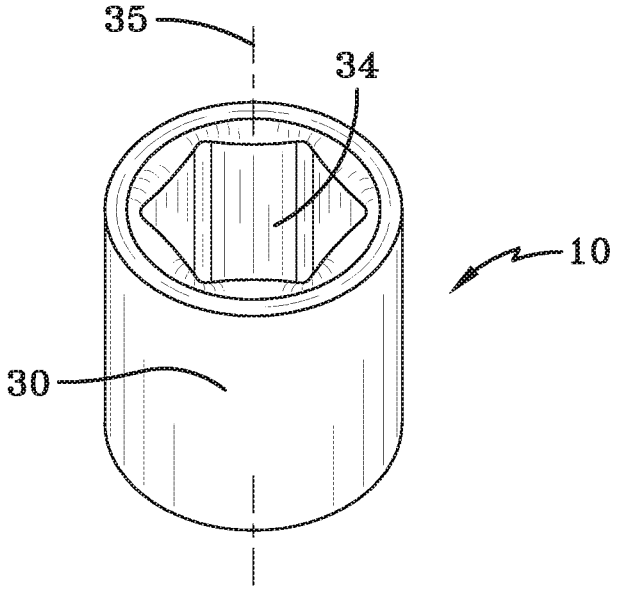
FIG. 1 is a perspective view of a socket wrench illustrating the shape of an embodiment in accordance with the present innovation.

The present invention is directed to an improved profiling ratchet wrench as shown in the enclosed figures. Referring now to the drawings wherein the drawings are for the purpose of illustrating preferred embodiment(s) of the present innovation and not for purposes of limiting the same, the present innovation will be discussed in greater detail. FIG. 1 shows a wrench socket 10 for turning a polygonally shaped element such as a conventionally known hexagonal threaded fastener. For the purpose of illustration, a hexagonal fastener 20 is shown in phantom in FIG. 2. Fastener 20 includes a number of planar faces 22 which are generally parallel and equidistant from a central axis 24. Faces or flanks 22 intersect at dihedral angles to form corners 26. The illustrated fastener 20 is considered as having standard dimensions for any given size and is within the maximum-minimum standard across opposed faces 22-22.

Figure 2:
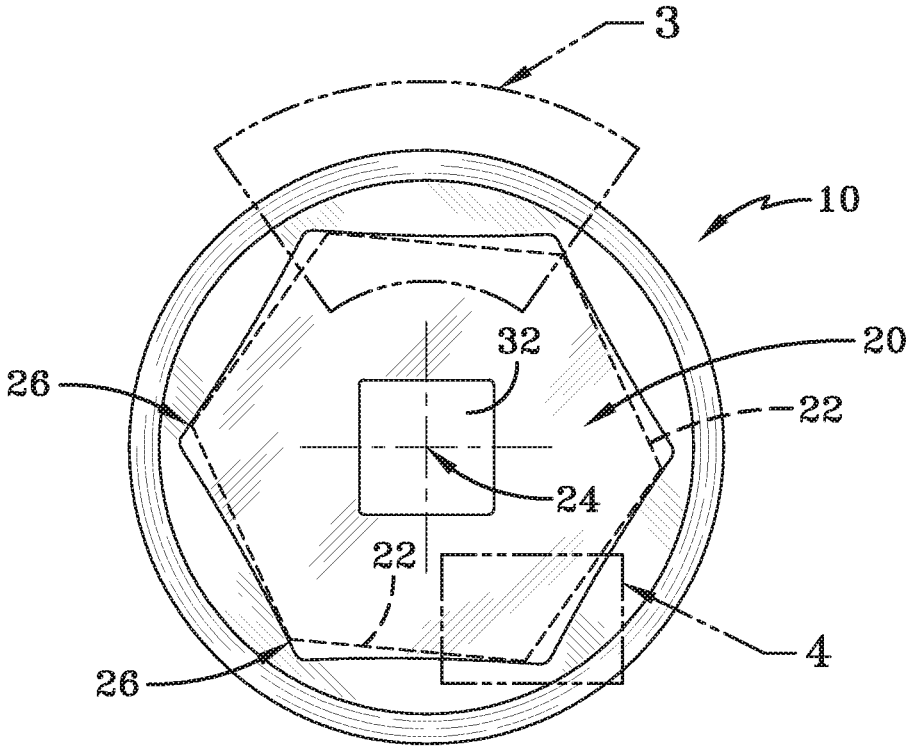
FIG. 2 is an enlarged plan view of the socket shown in FIG. 1.

The socket wrench 10 comprises of a generally cylindrical body 30 which is provided at one end with a substantially square socket 32 (as shown in FIG. 2) for receiving the operating stem of a suitable socket wrench, a motor driven spindle, or other actuating member known in the art (not shown). The opposing end of body 30 is provided with a work receiving cavity 34 which is symmetrical about an axis 35 and which as shown may be coincident with axis 24 of fastener 20. Cavity 34 is comprised of an even-numbered plurality of uniformly spaced peripherally and radially disposed side walls 36 having an equal number of nut corner clearance recesses 38 disposed therebetween. In embodiments shown and described, socket includes six (6) side walls and six (6) corresponding corner recesses. In other embodiments shown and described, socket includes twelve (12) side walls and twelve (12) corresponding corner recesses.

The aim of the different profiling is to provide robustness across the possible spectrum of real world items in both tools and fasteners, which may adhere to standard sizing and standard tolerancing, but would be different from an exact nominal number.

A prior innovation, commonly owned U.S. Pat. No. 5,284,073 to Wright, et al., (herein incorporated by reference in its entirety) discusses designing socket wrench openings and the like to avoid breakage of the wrench and/or deformation of a fastener to which the tool is put to use. For protecting the tool, it is desirable to minimize the stress exerted on the socket and the like. It is likewise desirable to distribute, as uniformly as possible, the stress exerted on the tool. Stress analysis indicates that important points of high stress exist when a tool engages the flank or face of a hexagonal or double hexagonal fastener or the like (or a comparable polygonal fastener as known in the art). It should be understood and appreciated that an area of stress is where the tool driving surface meets the fastener face. It should also be understood and appreciated that it is desirable that this surface be as large as possible to more uniformly distribute the stress throughout the socket. Prior innovation indicated that it may be important that the drive surface be, as nearly as possible, parallel to the fastener face to minimize peak stress. Such was achieved by orienting the drive surface at an angle which took into account a position of the tool when it engages the fastener, based on tolerances and free swing.

The disclosed innovation advances from this prior innovation with a different profile aspect. Parametric location of the revised feature maintains the relative benefits of the prior innovation and improves upon the contact area as will be discussed herein.

Other important areas of stress concentration were taught to be at an outer edge where the driving surface of the tool ceases to contact the fastener, which previously was considered to be at the corner of the fastener. Because there is an abrupt contact pressure area at the corner of the fastener which results in an abrupt stress peak, it is desirable that a driving surface not contact the fastener at the corner thereof. Another area of stress concentration is the portion of the tool adapted to receive the corner of the fastener. In conventional tool design, this area is a sharp arcuate angle which acts to concentrate the stress exerted on the tool.

Importantly, the claimed profile for a fastening tool permits longer forging punch life in the manufacture of the tool. In this respect, in the practical business of manufacturing tools, industry standards set certain tolerances which must be met and which affect the manufacture of the tools.

Generally, tool openings are tested with gauges which establish the maximum and minimum opening sizes. In the art, it is generally well known that the corners of the forging punches can wear faster than the flat engaging surfaces of the punch. It has been known to use as large a punch as possible so as to give a reasonable amount of wear on the corners before they become undersized. This results in the across flats dimension being on the large size if the punch is a hexagon design because the across the flats dimension is fixedly linked to the across the corners dimension of the punch. The present innovation enables a punch having a reduced across the flat dimension wherein the initial size of the punch can be dimensioned to lie in the midsize of the gauging range. As set forth above, the included angle of the driving surfaces of the wrench (as reflected in the parametric profile of the two radii, as will be discussed in greater detail herein) are oriented to compensate for the rotation that occurs between the wrench and fastener in the process of engagement. The parametric profiling is chosen so as to produce close to parallel engagement between the engaging surface of the tool and the flat portion of the fastener over the range of acceptable fastener sizes, as well as standard tolerances for those fastener sizes. Thus, in addition to providing a tool opening which reduces and distributes more evenly the internal stress exerted on the tool during driving, the present design facilitates reproduction of the tool, as well as forging punch life.

It has been determined that the range of replacing an angled flat section of a profile contour with a selected radial contour, at a selected point of the overall contour provides unexpected improvement in mating zone dimensions. Placement of the selected radial contour is driven by considerations of rotational impacts of tolerance variations (per industry standard tolerance allowances) for both portions of the fastening system. In other words, placement of the replacing curvature has been evaluated based on tolerances that are permitted for fasteners as well as tolerances permitted for fastening tools. By evaluating impact zones across the full range of conditions, a particular configuration is determined.

Figure 3:
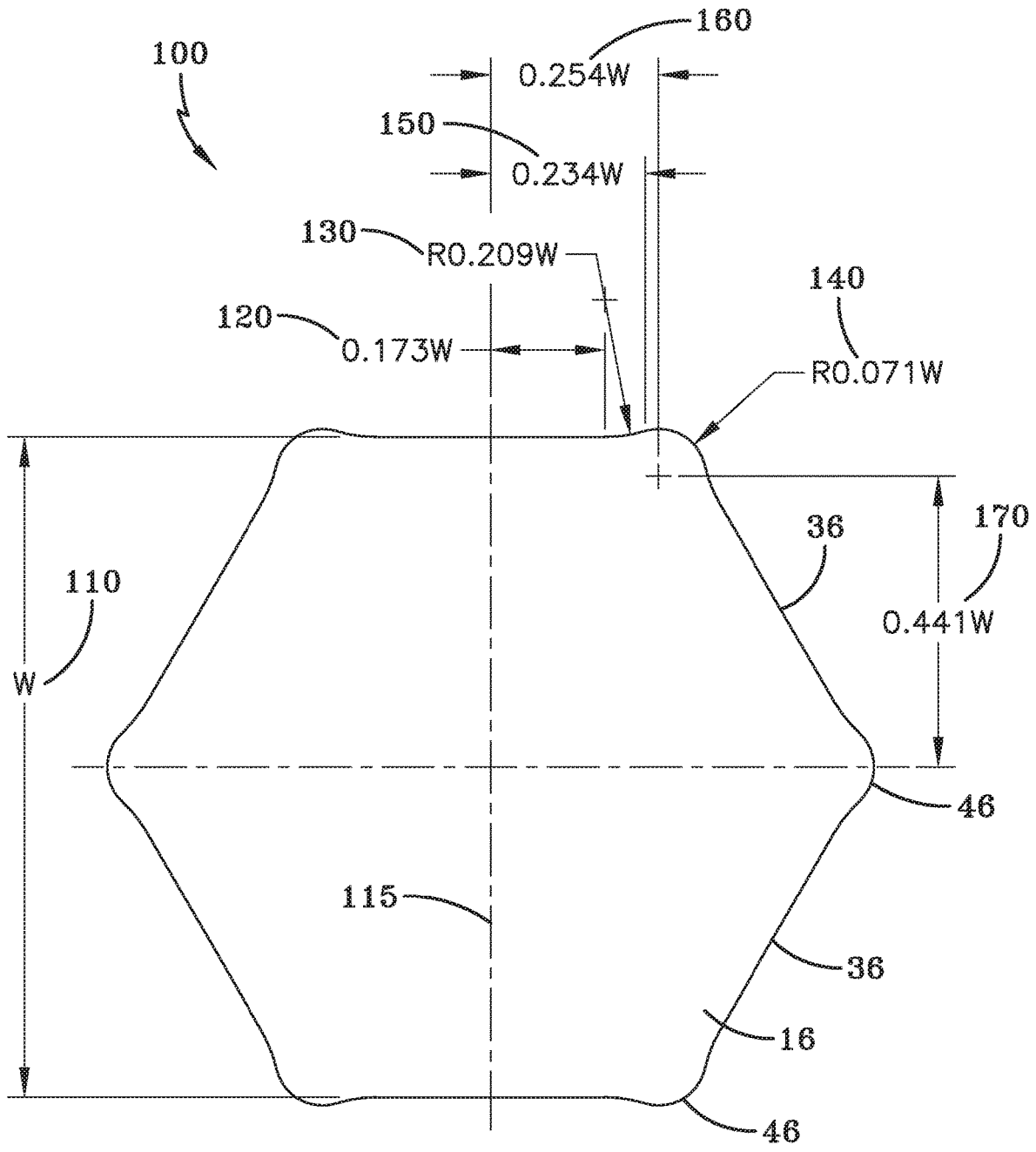
FIG. 3 is a plan view of a tool profile applying a Wright Number in accordance to a preferred embodiment of the invention.
Figure 4:
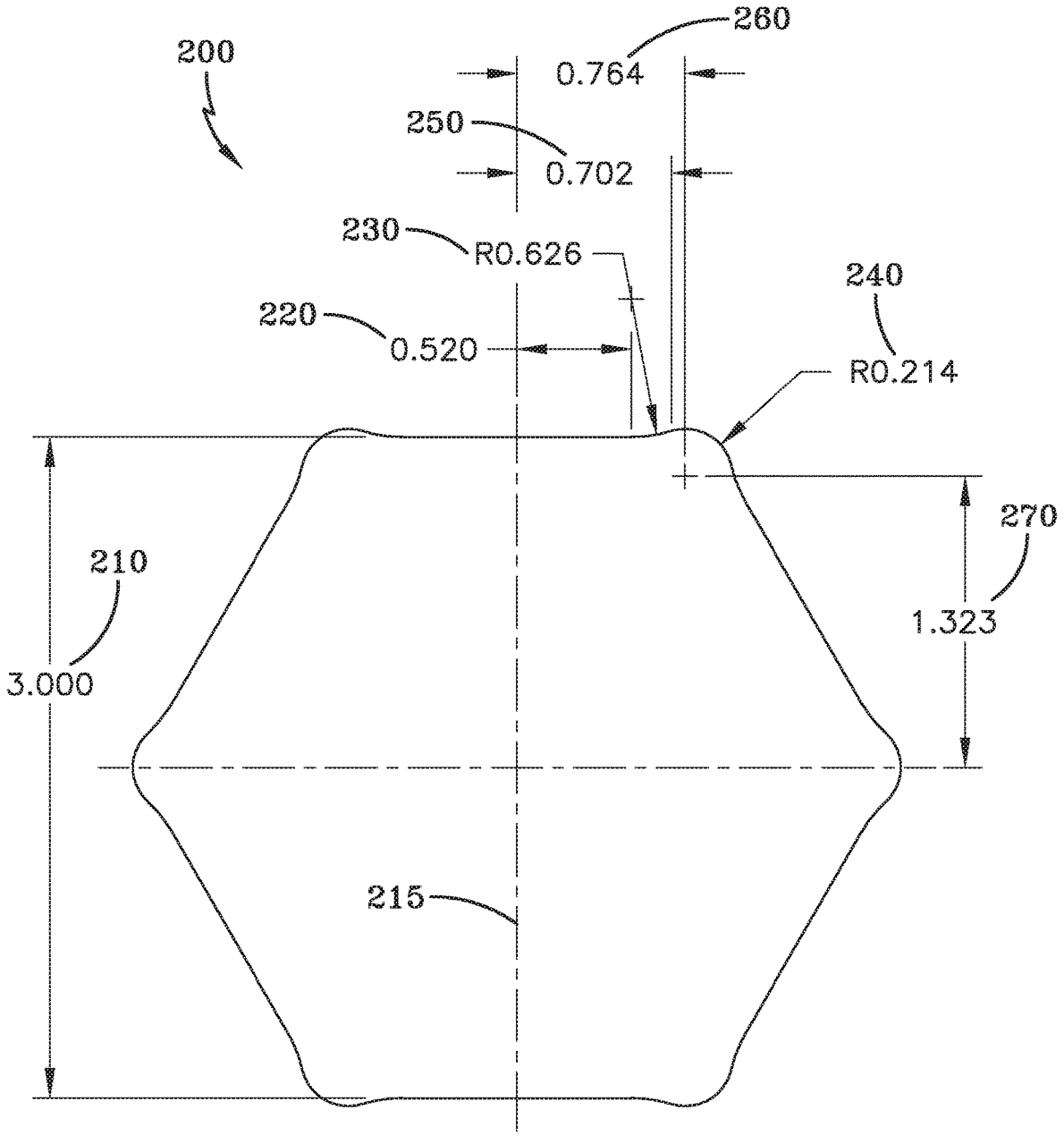
FIGS. 4 through 6 are example plan views of tool profiles according to a preferred embodiment of the invention.
Figure 5:
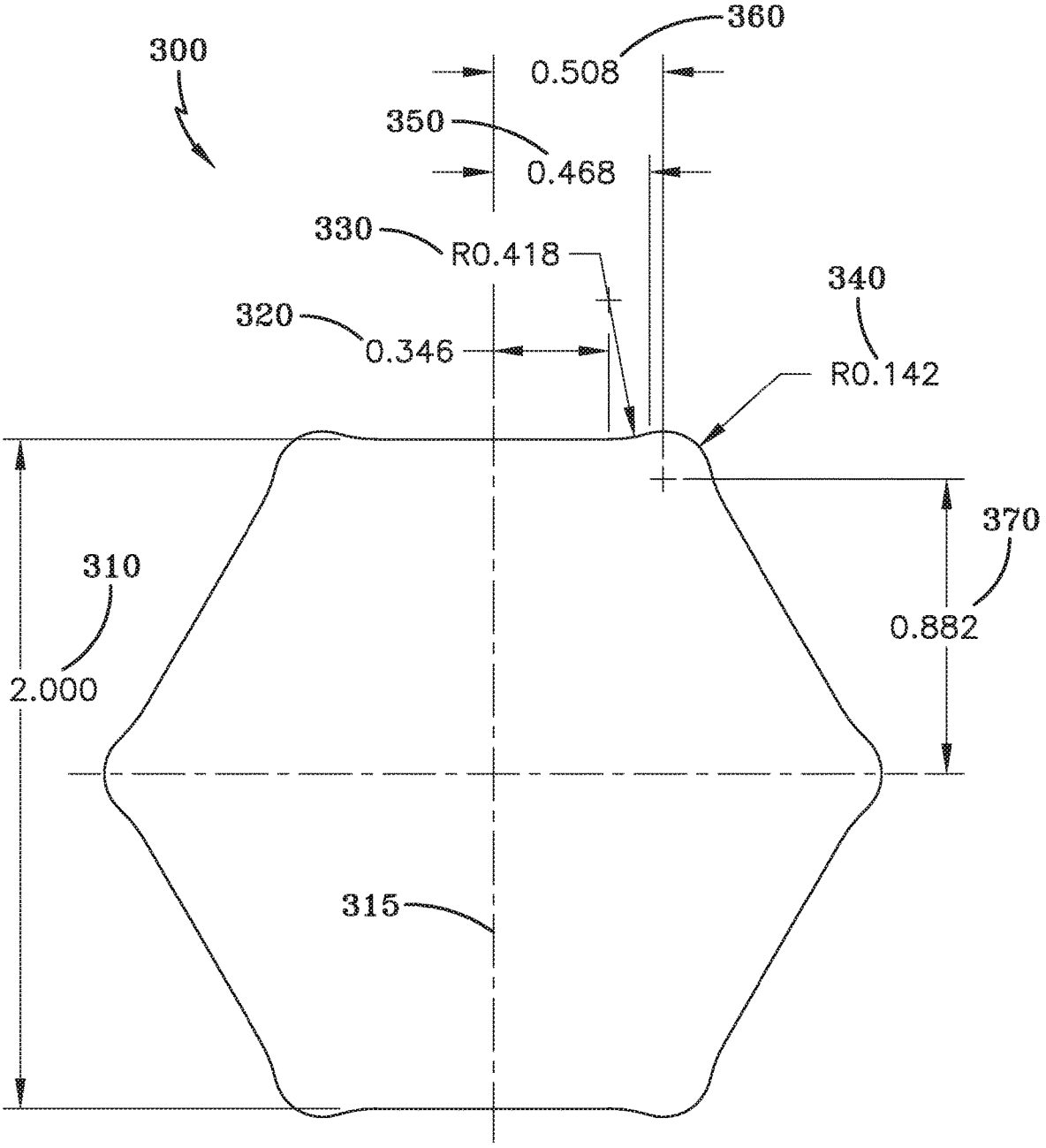
Figure 6:
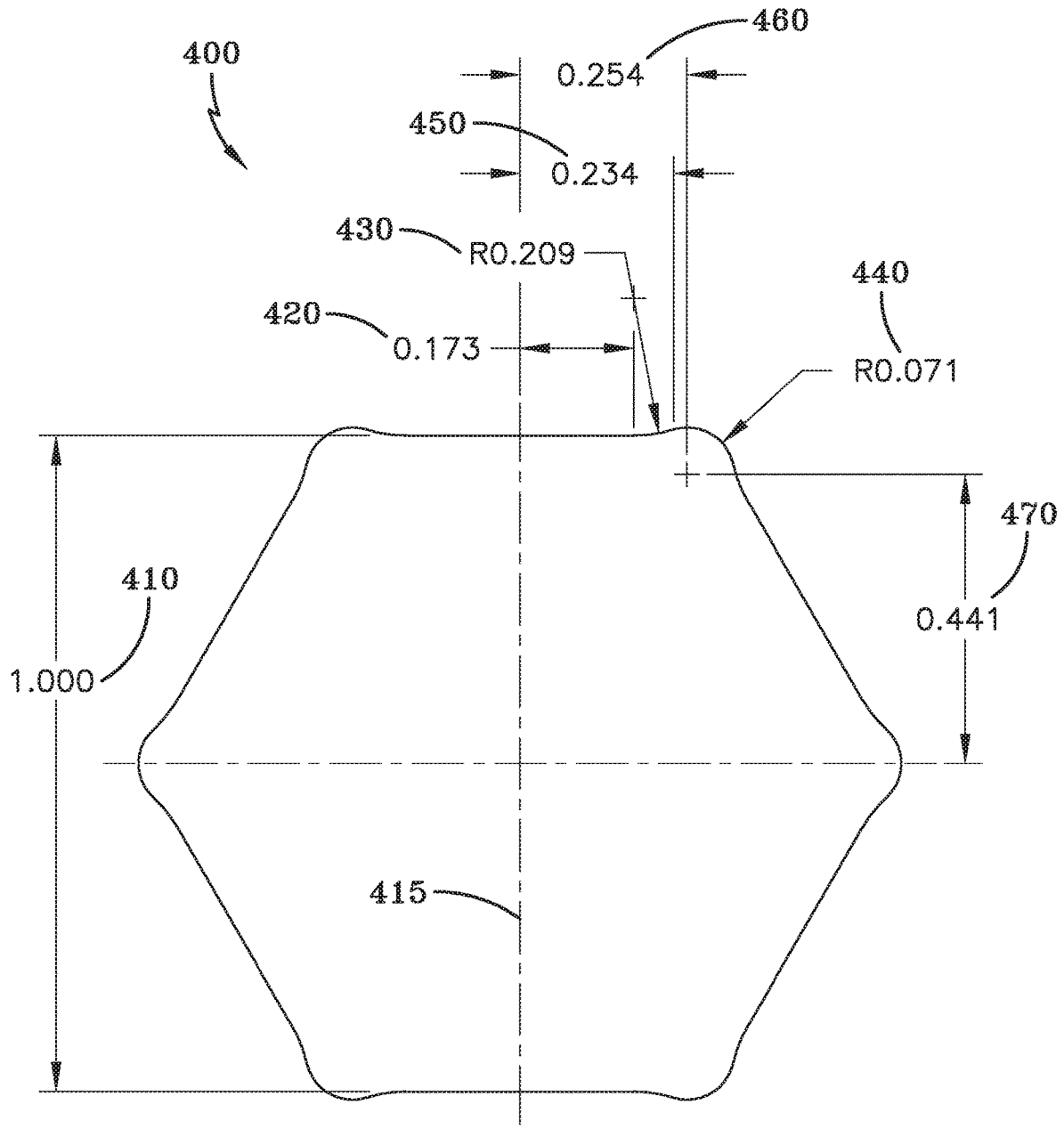

Referring now to the figures, FIGS. 4-6 as examples of three sizes, and FIG. 3 as an example of the profile being parametric and thus non-dimensionalized, and thus applicability to scalability to almost any standard fastener sizes/configurations are shown and described. For example, FIG. 4 illustrates where the profile configuration points for a fastener of a 3-inch size (determined for the permitted tolerance ranges associated with industry standards for this size). Likewise, FIG. 5 illustrates where the profile configuration points for a fastener of a 2-inch size (likewise determines for the permitted tolerance ranges associated with industry standards for that size). Furthermore, FIG. 6 illustrates where the profile configuration points for a fastener of a 1-inch size (likewise determines for the permitted tolerance ranges associated with industry standards for that size).

As should be appreciated, each of the profile configuration points can be realized as a scalable factor tied to a fastener element.

Referring to FIG. 3, a profile configuration point for this scaled, or parametric number is shown and provided. The non-dimensional number may be, for example, called the Wright Number. Reference is made to Table 1 herewith. Thus, specifying the innovation for a standard fastener may be accomplished by selecting an appropriate Wright Number. It is to be appreciated that in applying the innovation for a range of Wright Numbers, it may be possible and may be desired to modify the Wright Number for known or selected material characteristics of either or both of tool and fastener materials. In other words, a profile may be configured to be based on $\alpha W$ rather than W, with a determined in relation to variables such as material of tool, material of fastener, any present coatings, and the like.

Turning to FIG. 3, a profile 100 for a fastening tool for turning a fastener is depicted. In this embodiment, the fastening tool (not shown) is configured to turn a fastener having a central axis and a plurality of flat bounding surfaces parallel to the central axis with diametrically opposed pairs of flat bounding surfaces being parallel to each other, and the bounding surfaces of the fastener meeting to form fastener corners. The profile 100 for the fastening tool has a central open axis 16 and comprises a plurality of uniformly spaced sides 36 disposed peripherally and radially about said central axis 16, said sides being equal in number to the number of flat bounding surfaces of the fastener to be turned and diametrically opposed sides being generally parallel. The distance between the uniformly spaced sides as measured by the face to face distance 110 is defined as a Wright number (W).

The profile includes a plurality of uniformly spaced corner recesses 46 disposed peripherally and radially about said central opening axis 16, wherein each recess 46 is parametrically sized to accept a fastener corner, each corner recess profile being part of a circle having a radius of curvature 140 of approximately 0.071 multiplied by the Wright number 110 and having a center located symmetrically about the center 115 of the central axis typified by a first center located at an "X" Cartesian dimension 160 of 0.254 multiplied by the Wright number and an "Y" Cartesian dimension 170 of 0.441 multiplied by the Wright number. Each uniformly spaced side 36 transitions symmetrically about the center of the corner recess typified by a two transitions, the first typified by a symmetrical transition 120 (located at the top flat at an "X" Cartesian dimension of 0.173 multiplied by the Wright number), to a top second radius 130 of curvature of 0.209 multiplied by the Wright number. A second transition typified by 150 has the radius of curvature flowing from the top flat (as pictured) having a tangent point to the radius of curvature of the pocket 140 with an "X" Cartesian dimension 150 of 0.234 multiplied by the Wright number.

Turning to FIG. 4, a profile 200 is shown that comprises a flat to flat dimension 210 of 3.000 (or "Y" of 1.500 inches), and a center 215 of an inscribed hexagon. Measuring from that center 215, (and being reflected in the apparent symmetry), the profile has a transition point 220 of "X" equal to 0.520 inches along the upper inscribed flat. The transition point applies a tangent to a constant radius 230 of 0.626 inches, which transitions to a second radius 240 (R=0.214), at the combined tangent point 250 at an "X" dimension of 0.702 inches. The second radius 240 has a center at an "X" dimension 260 of 0.764 inches and a "Y" dimension 270 of 1.323 inches. It is to be appreciated that the symmetry continues along the profile in that the 0.214 radius 240 transitions at a combined tangent point to a similar 0.626 radius that transitions to a second "flat to flat" profile section. It is to be further appreciated that the profiling may be made symmetrical for a 12-point type of fastening tool as shown and described at FIGS. 12-18.

Turning to FIG. 5, a profile 300 is shown that comprises a flat to flat 310 dimension of 2.000 (or "Y" of 1.000 inches), and a center 315 of an inscribed hexagon. Measuring from that center 315, (and being reflected in the apparent symmetry), the profile has a transition point 320 of "X" equal to 0.346 inches along the upper inscribed flat. The transition point applies a tangent to a constant radius 330 of 0.418 inches, which transitions to a second radius 340 (R=0.142), at the combined tangent point at an "X" dimension of 0.468 inches. The second radius 340 has a center at an "X" dimension 360 of 0.508 inches and a "Y" dimension 370 of 0.882 inches. It is to be appreciated that the symmetry continues along the profile 300 in that the 0.142 radius 340 transitions at a combined tangent point to a similar 0.418 radius that transitions to a second "flat to flat" profile section. It is to be further appreciated that the profiling may be made symmetrical for a 12-point type of fastening tool as shown and described at FIGS. 12-18.

Turning to FIG. 6, a profile 400 is shown that comprises a flat to flat 410 dimension of 1.000 (or "Y" of 0.500 inches), and a center 415 of an inscribed hexagon. Measuring from that center 415, (and being reflected in the apparent symmetry), the profile has a transition point 420 of "X" equal to 0.173 inches along the upper inscribed flat. The transition point 420 applies a tangent to a constant radius 430 of 0.209 inches, which transitions to a second radius 440 (R=0.071), at the combined tangent point at an "X" dimension of 0.234 inches. The second radius 440 has a center at an "X" dimension 460 of 0.254 inches and a "Y" dimension 470 of 0.441 inches. It is to be appreciated that the symmetry continues along the profile 400 in that the 0.071 radius 440 transitions at a combined tangent point to a similar 0.209 radius that transitions to a second "flat to flat" profile section. It is to be further appreciated that the profiling may be made symmetrical for a 12-point type of fastening tool as shown and described in more detail at FIGS. 12-18.

Turning back to FIG. 3, a profile 100 is shown, and referring to FIGS. 4-6, it is to be appreciated that the profile attributes may be considered fully parametric. That is, in other words, each of the profile points may be provided in terms of a single number. Specifying a single number (defined as the Wright number for example) fully specifies the profile. As seen in FIG. 3, the profile 100 comprises a flat to flat dimension 110 of W (or "Y" of W/2 inches), and a center 115 of an inscribed hexagon. Measuring from that center, (and being reflected in the apparent symmetry), the profile has a transition point 120 of "X" equal to 0.173×W inches along the upper inscribed flat. The transition point applies a tangent to a constant radius 130 of 0.209×W inches, which transitions to a second radius 140 (R=0.071×W), at the combined tangent point 150 at an "X" dimension of 0.234×W inches. The second radius 140 has a center at an "X" dimension 160 of 0.254×W inches and a "Y" dimension 170 of 0.441×W inches. It is to be appreciated that the symmetry continues along the profile 100 in that the 0.071×W radius 140 transitions at a combined tangent point to a similar 0.209×W radius that transitions to a second "flat to flat" profile section. It is to be further appreciated that while not shown, the profiling may be made symmetrical for a 12-point type of fastening tool as shown and described at FIGS. 12-18.

FIGS. 1-4 are reflected in Table 1.

TABLE 1

| Item (FIG.) | face to face dimension | X to pocket | Y to pocket | R1 (pocket) | X of Face flat trans point R2 | R2 | X of combined tangent and R2 |
|---|---|---|---|---|---|---|---|
| 4 | 3 | 0.764 | 1.323 | 0.214 | 0.52 | 0.626 | 0.702 |
| 5 | 2 | 0.508 | 0.882 | 0.142 | 0.346 | 0.418 | 0.468 |
| 6 | 1 | 0.254 | 0.441 | 0.071 | 0.173 | 0.209 | 0.234 |
| 3 (Wright Number) | W | 0.254W | 0.441W | 0.071W | 0.173W | 0.209W | 0.234W |

(note that X, Y are from a central axis of an inscribed polygon to the overall profile).

Figure 7:
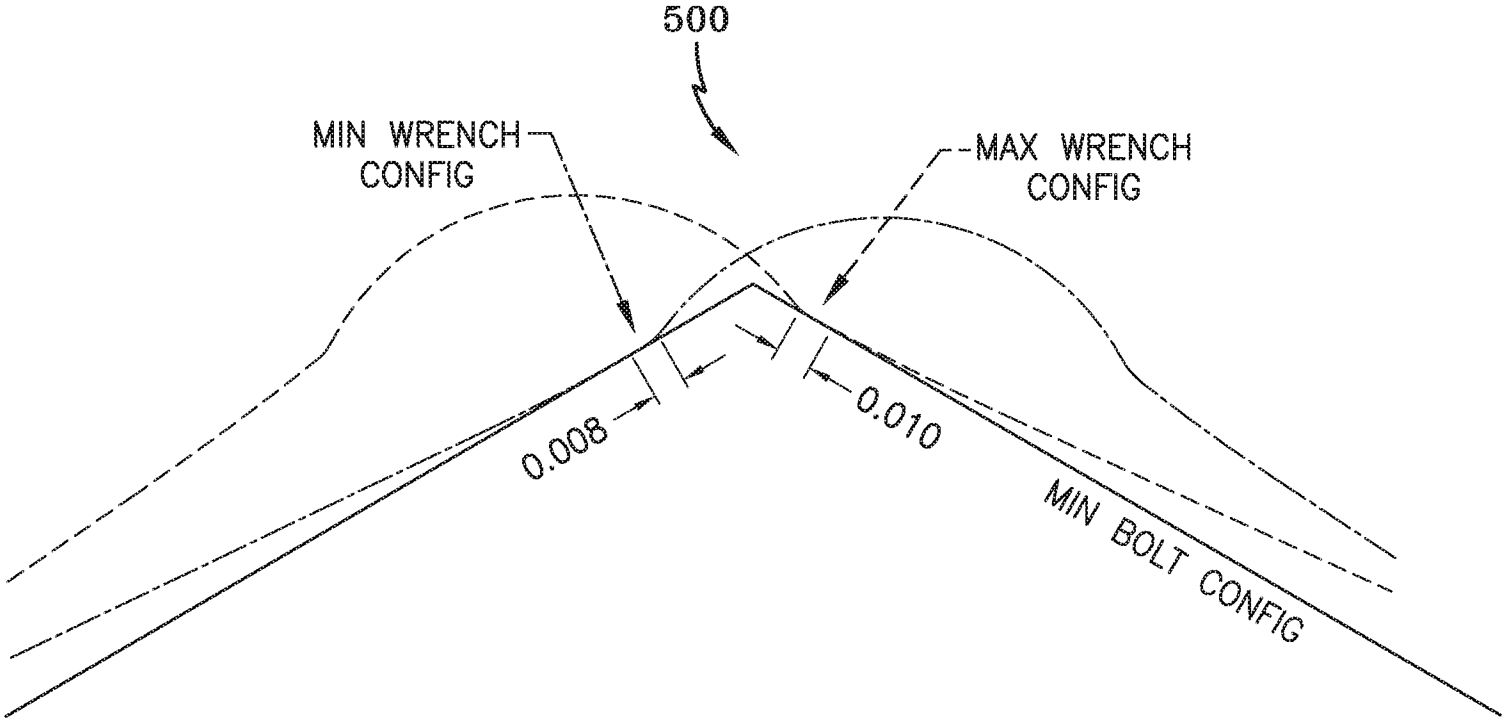
FIG-7 Prior Art
FIG. 7 is a prior art plan view of a portion of a profile in accordance with viewing tolerance effects.
Figure 8:
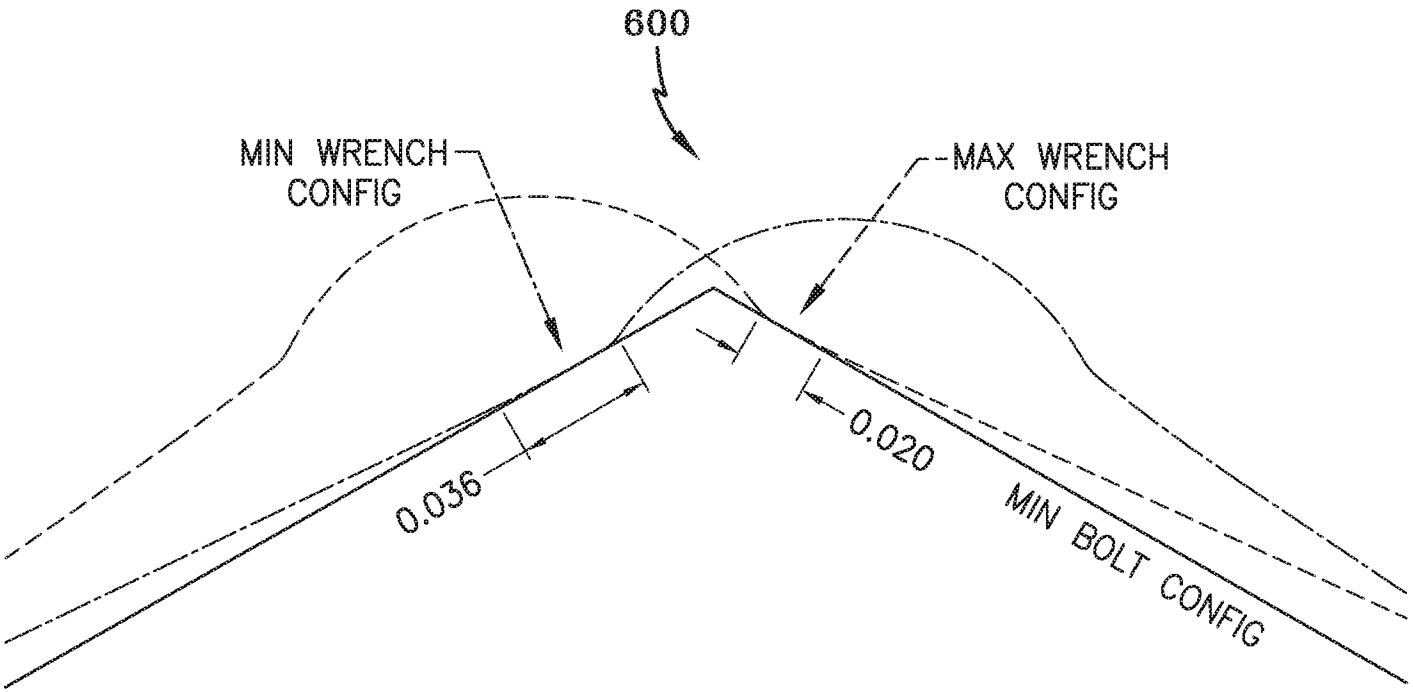
FIG. 8 is a plan view of a portion of a profile in accordance with viewing tolerance effects according to a preferred embodiment of the invention.

Turning now to FIGS. 7 and 8, disclosure of the improved landing area is explicated in an embodiment. FIG. 7 exhibits a then state-of-the-art prior art fastening system comprising a particular fastening tool as disclosed in commonly owned U.S. Pat. No. 5,284,073 with a fastener configured to be at the minimal size per industry standard tolerances at reference 500. The profile as per the prior art is shown at both a maximum tolerance tool profile and a minimum tolerance tool profile. It is to be appreciated that the maximum difference, and thus minimum contact area is to be generally generated at a condition of maximum tolerance for the tool and minimum tolerance for the fastener. As shown in FIG. 7, the prior art provides a minimum contact area of 0.010 inches for a minimum tolerance fastener/maximum tolerance tool configuration, and a contact area of 0.008 inches for a minimum tolerance fastener/minimum tolerance tool configuration. This contrasts with the fully parametric profile shown in FIG. 8 at reference 600. In FIG. 8, which is an improvement over FIG. 7, a minimum contact area of 0.020 inches for a minimum tolerance fastener/maximum tolerance tool configuration (a 100% improvement), and a contact area of 0.036 inches for a minimum tolerance fastener/minimum tolerance tool configuration. This represents a 350% improvement which is a significant improvement.

Figure 9:
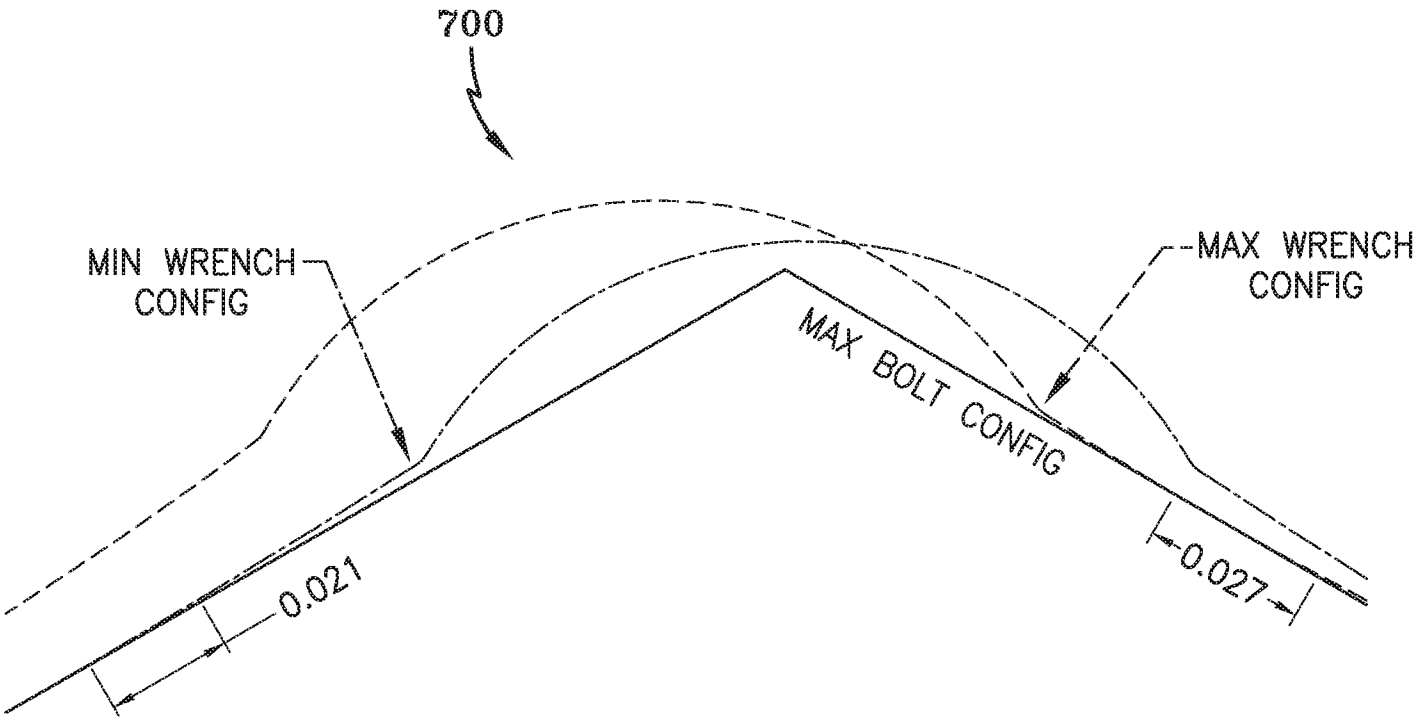
FIG–9 Prior Art
FIG. 9 is a prior art plan view of a portion of a profile in accordance with viewing tolerance effects.
Figure 10:
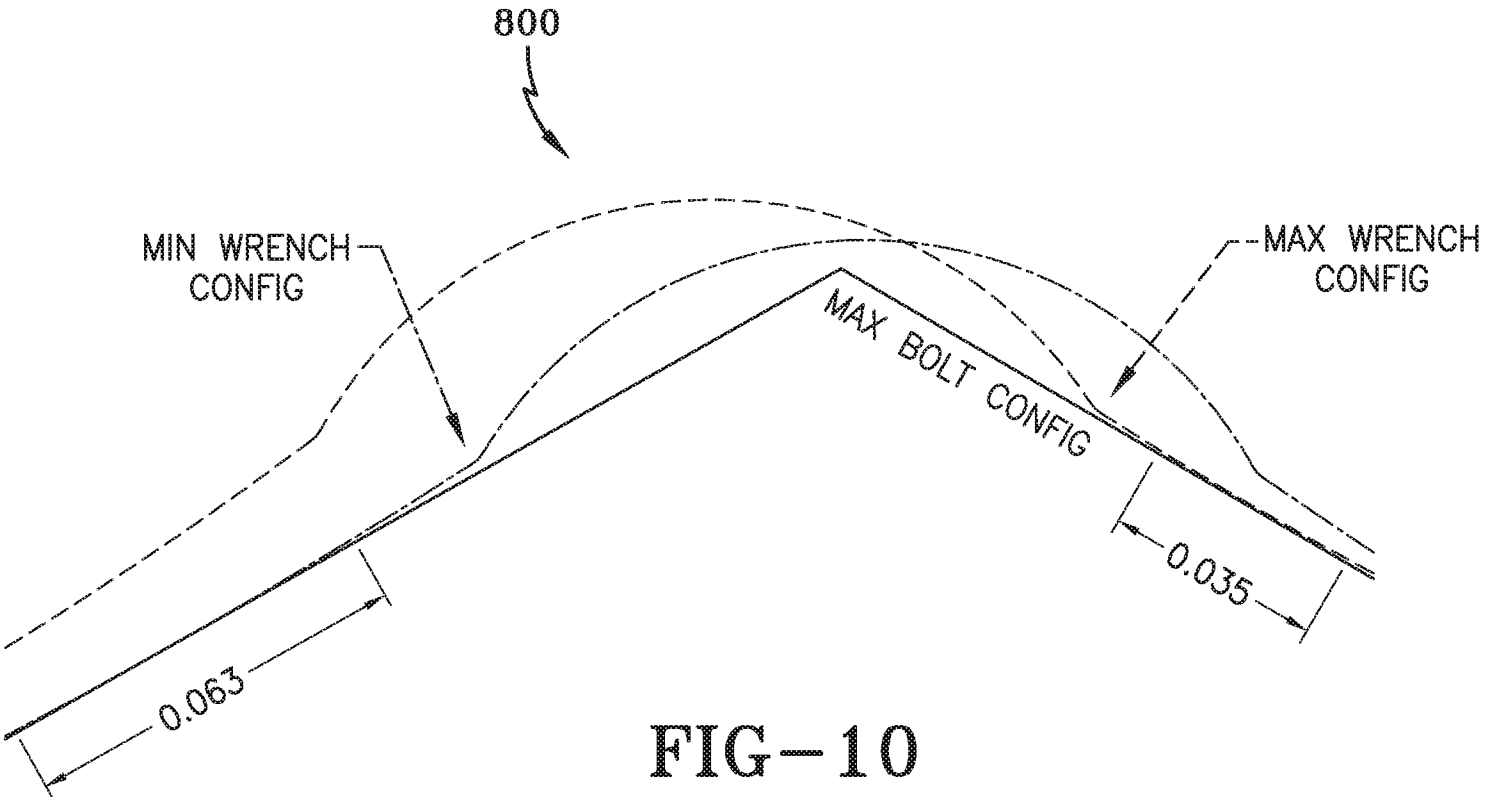
FIG. 10 is a plan view of a portion of a profile in accordance with viewing tolerance effects according to a preferred embodiment of the invention.

Turning now to FIGS. 9 and 10, disclosure of the improved landing area is explicated in an embodiment according to another set of tolerance configurations. FIG. 9 exhibits a prior art fastening system comprising a particular fastening tool as disclosed in commonly owned U.S. Pat. No. 5,284,073 with a fastener configured to be at the maximum size per industry standard tolerances at reference 700. The profile as per the prior art is shown at both a maximum tolerance tool profile and a minimum tolerance tool profile. It is to be appreciated that these tolerance matchups generally provide the maximum landing area of a fastening system. As shown in FIG. 9, the prior art provides a contact length of 0.027 inches for a maximum tolerance fastener/maximum tolerance tool configuration, and a contact length of 0.021 inches for a maximum tolerance fastener/minimum tolerance tool configuration. This contrasts with the fully parametric profile shown in FIG. 10 at reference 800. In FIG. 10, a contact length of 0.035 inches for a maximum tolerance fastener/maximum tolerance tool configuration (a 30% improvement), and a contact length of 0.063 inches for a maximum tolerance fastener/minimum tolerance tool configuration (a 200% improvement).

Figure 11:
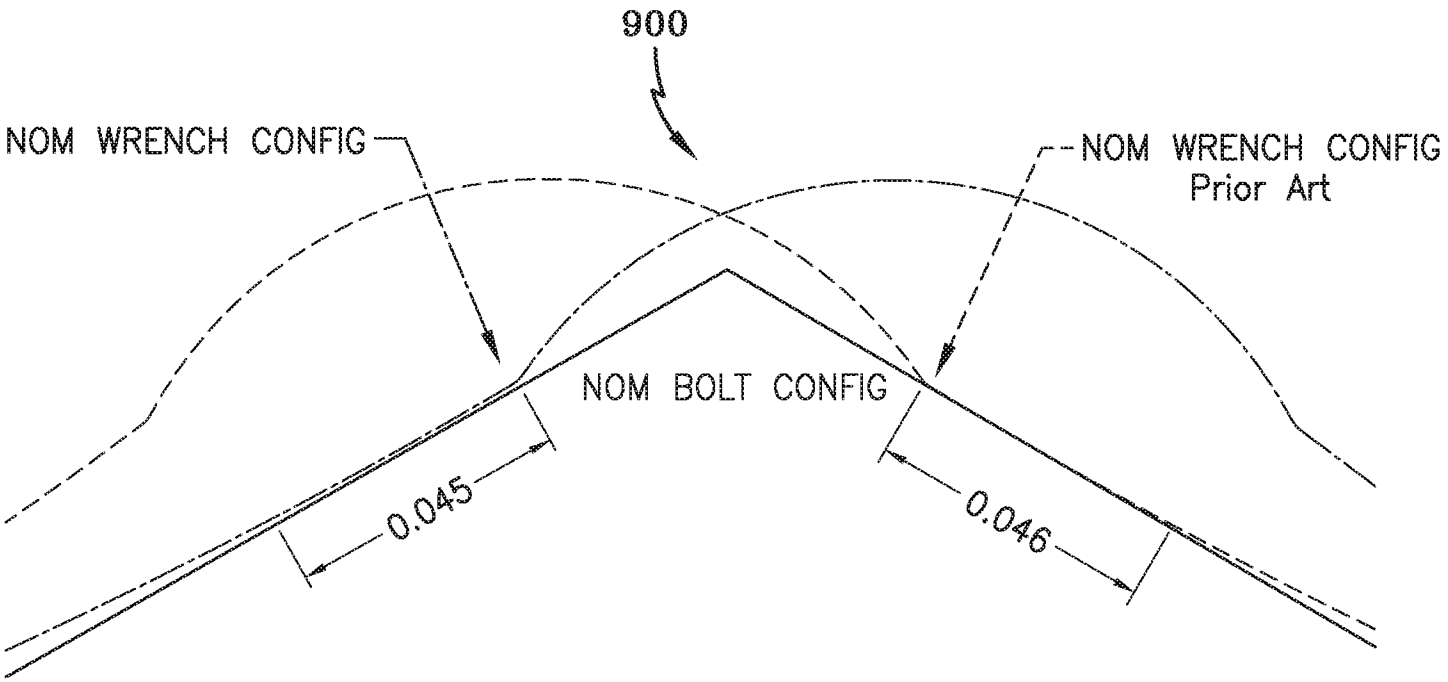
FIG. 11 is a plan view of a comparison of a portion of a profile according to a preferred embodiment of the invention to a portion of a prior art profile in accordance with viewing nominal or no tolerance effects.

Turning now to FIG. 11, disclosure of the landing area of the fully parametric profile with the prior art profile of a prior art fastening system comprising a particular fastening tool (as disclosed in commonly owned U.S. Pat. No. 5,284,073) at nominal dimensioning of tools and fasteners at reference 900 is shown and described. As can be seen, at nominal dimensions, the landing areas are roughly equivalent. It is to be appreciated that the present innovation provides an improved landing area in various tolerance conditions, and provides an equivalent landing area at a nominal condition. Furthermore, the ease of providing a singular parametric value captures all of the improvements across all possible standard variances.

Figure 12:
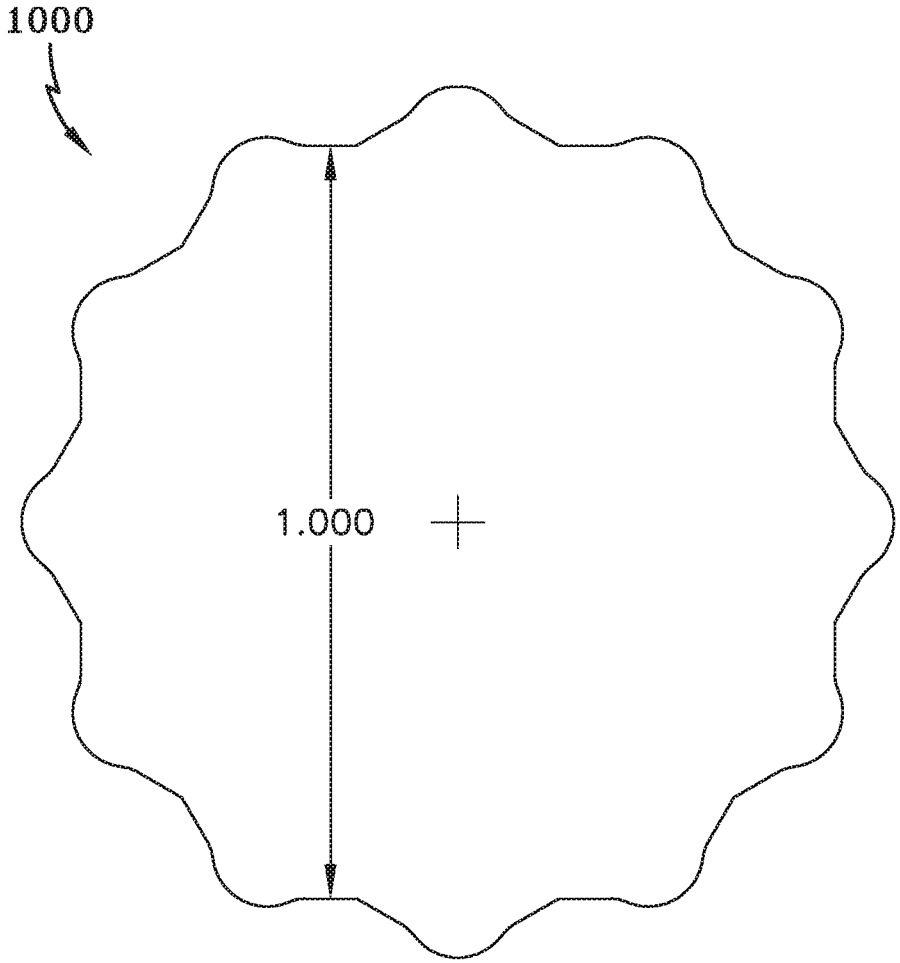
FIGS. 12-18 are various plan views of a comparison of a portion of a profile according to another embodiment of the invention to a portion of a prior art profile in accordance with viewing nominal and maximum tolerances.
Figure 13:
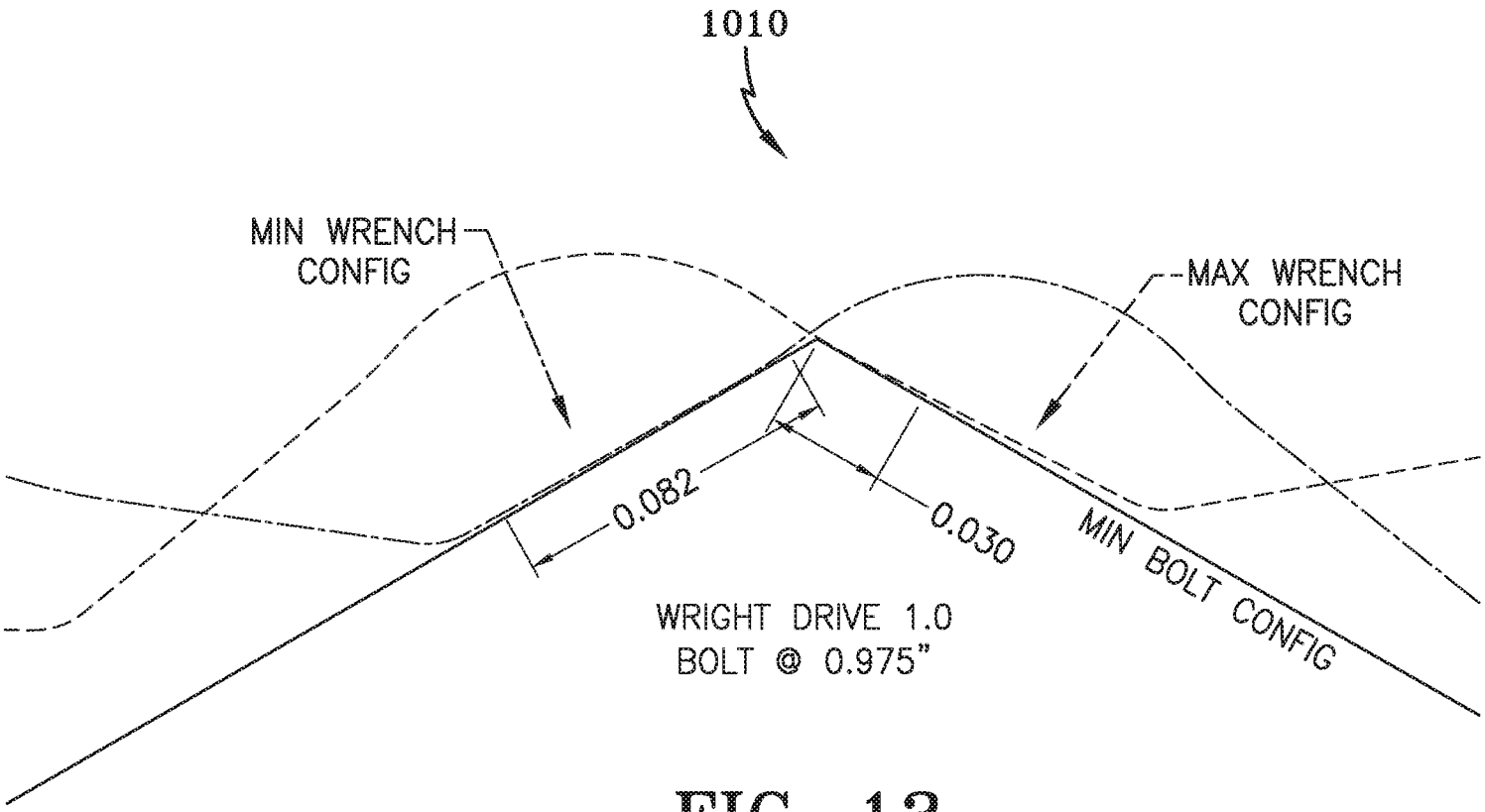
FIG-13 Prior Art
Figure 14:
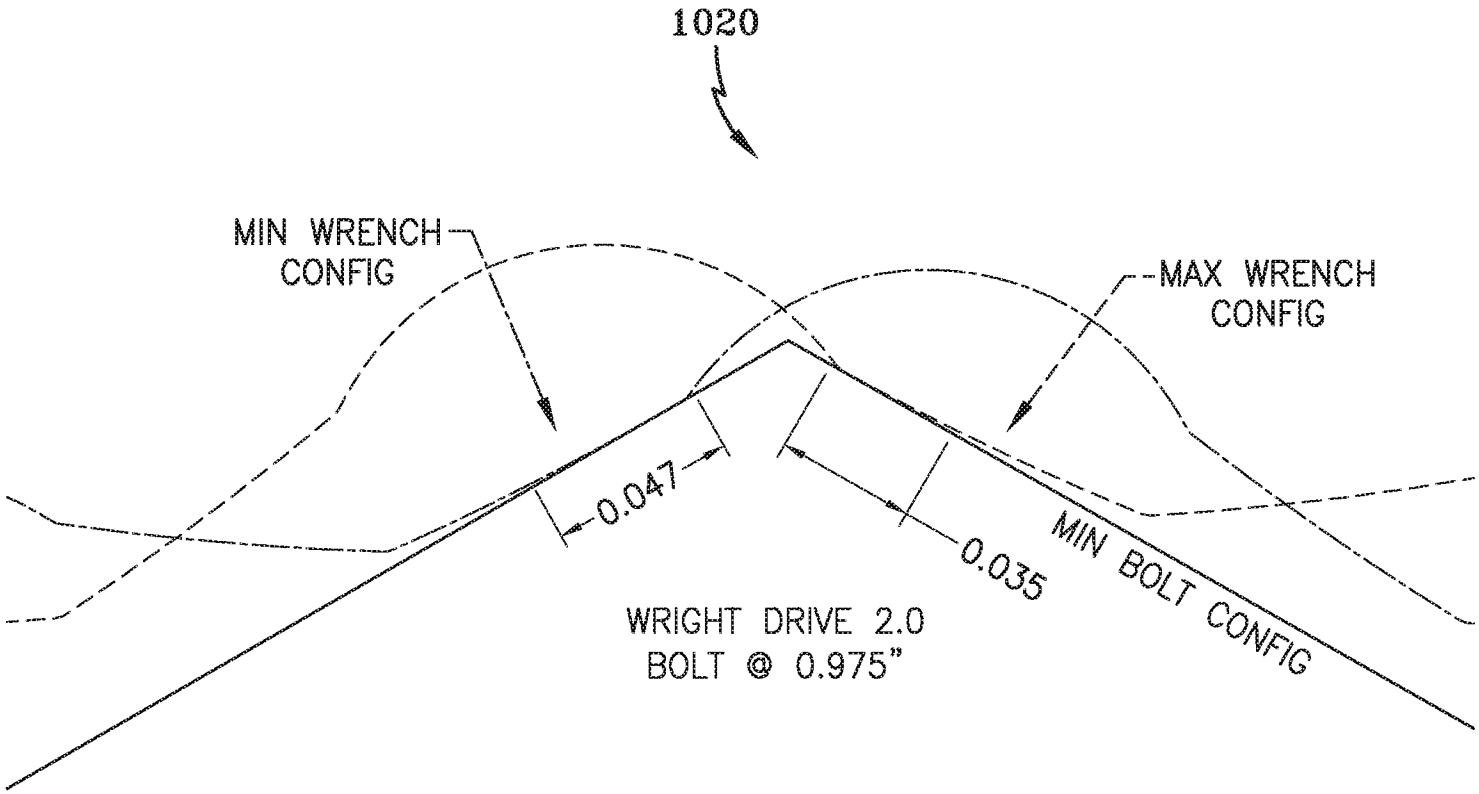

Turning now to FIGS. 12 through 18, disclosure of the improved landing area is explicated in an embodiment of a 12-point socket as shown at reference 1000 (FIG. 12). FIG. 13 (Min. Bolt Configuration) exhibits a then state-of-the-art prior art fastening system comprising a particular 12-point fastening tool as disclosed in commonly owned U.S. Pat. No. 5,284,073 with a fastener configured to be at the minimal size per industry standard tolerances at reference 1010. The profile as per the prior art is shown at both a maximum tolerance tool profile and a minimum tolerance tool profile. It is to be appreciated that the maximum difference, and thus minimum contact area is to be generally generated at a condition of maximum tolerance for the tool and minimum tolerance for the fastener. As shown in FIG. 13, the prior art provides a minimum contact area of 0.030 inches for a minimum tolerance fastener/maximum tolerance tool configuration, and a contact area of 0.082 inches for a minimum tolerance fastener/minimum tolerance tool configuration. This contrasts with the fully parametric profile shown in FIG. 14 at reference 1020. In FIG. 14 (Min. Bolt Configuration), a minimum contact area of 0.035 inches for a minimum tolerance fastener/maximum tolerance tool configuration, and a contact area of 0.047 inches for a minimum tolerance fastener/minimum tolerance tool configuration.

Figure 15:
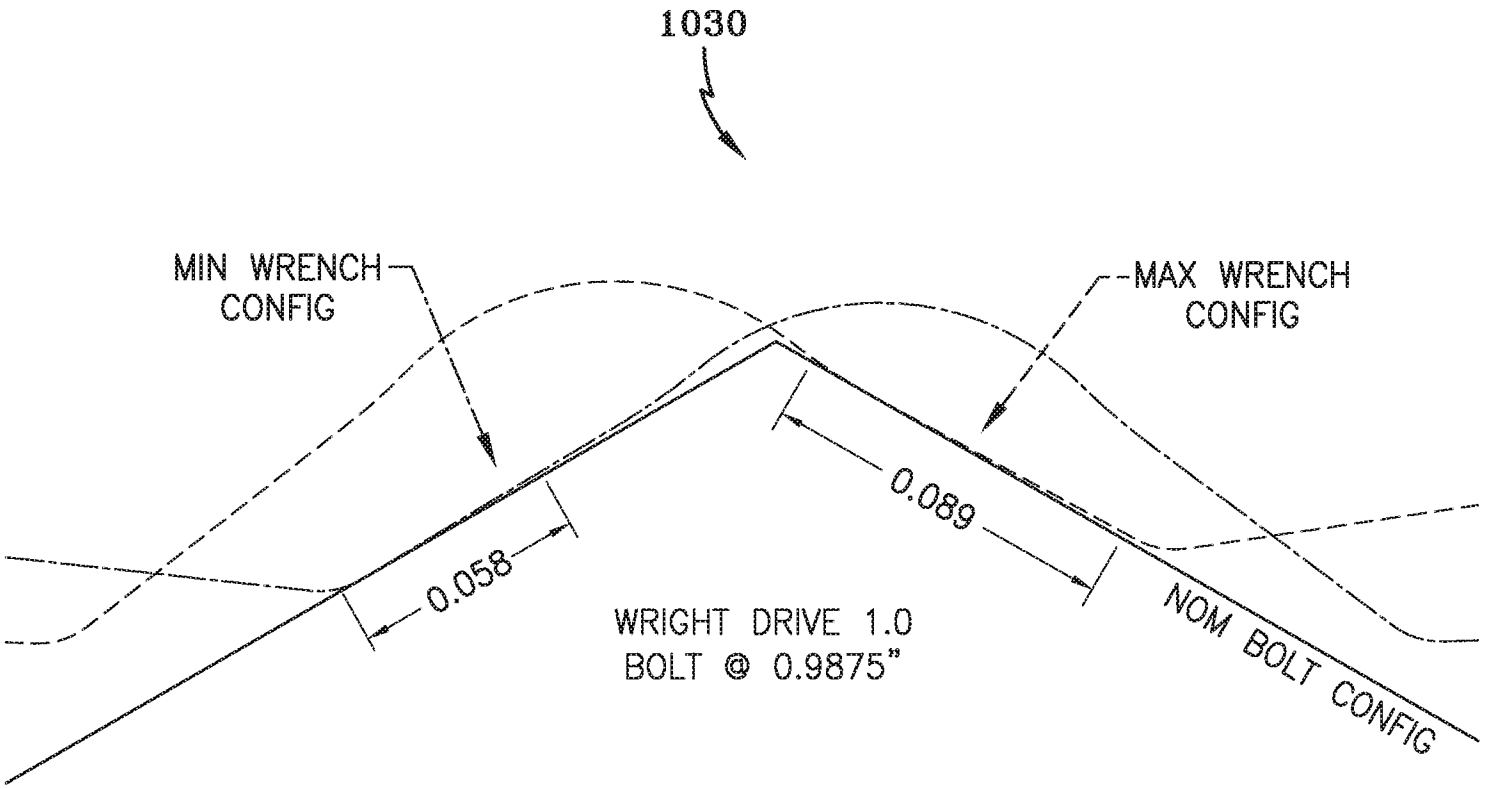
FIG-15 Prior Art
Figure 16:
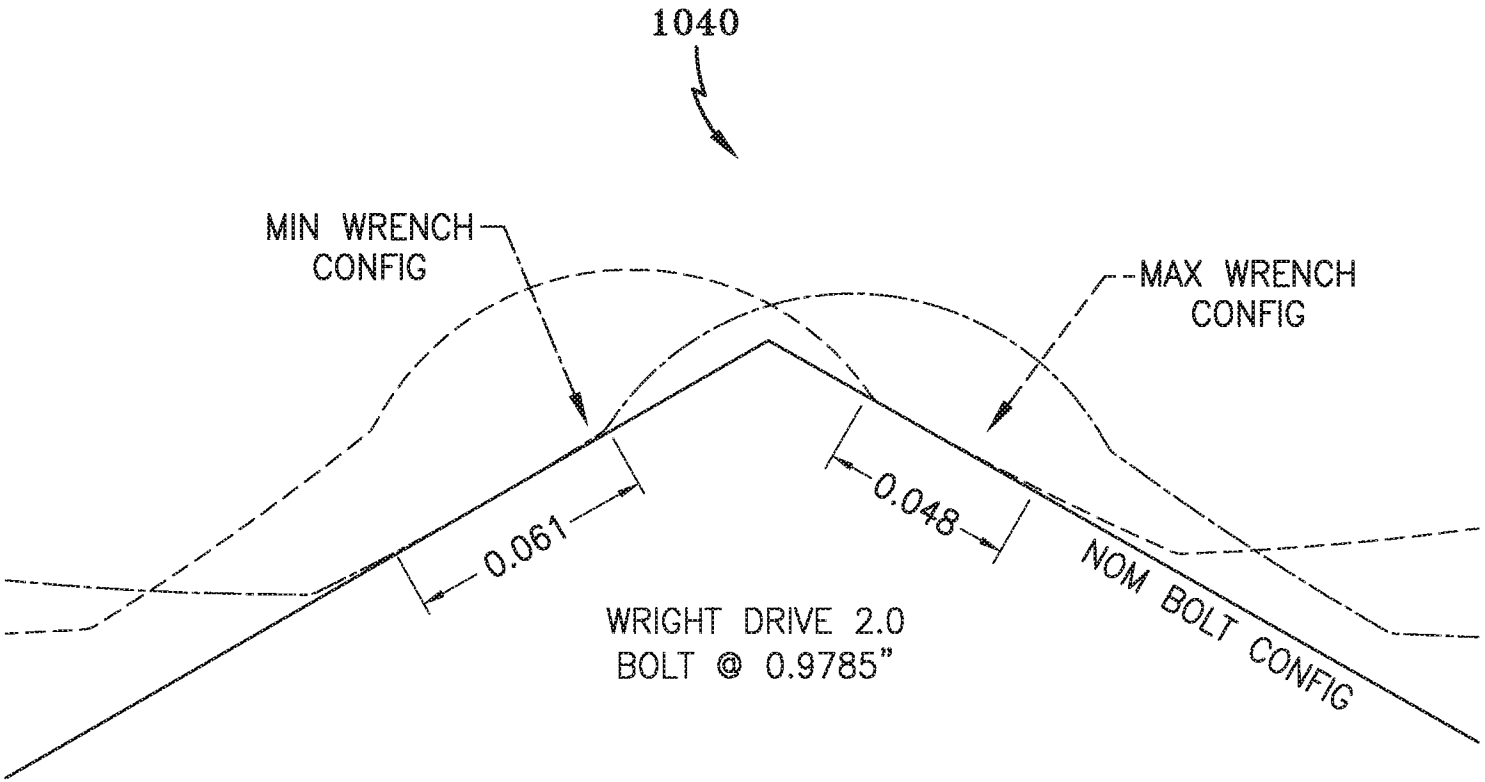

Turning now to FIGS. 15 and 16, disclosure of the improved landing area is explicated in an embodiment of a 12-point socket as shown at reference 1030 (FIG. 15). FIG. 15 (Nominal Bolt Configuration) exhibits a then state-of-the-art prior art fastening system comprising a particular 12-point fastening tool as disclosed in commonly owned U.S. Pat. No. 5,284,073 with a fastener configured to be at the minimal size per industry standard tolerances at reference 1030. The profile as per the prior art is shown at both a maximum tolerance tool profile and a minimum tolerance tool profile. It is to be appreciated that the maximum difference, and thus minimum contact area is to be generally generated at a condition of maximum tolerance for the tool and minimum tolerance for the fastener. As shown in FIG. 15, the prior art provides a minimum contact area of 0.089 inches for a minimum tolerance fastener/maximum tolerance tool configuration, and a contact area of 0.058 inches for a minimum tolerance fastener/minimum tolerance tool configuration. This contrasts with the fully parametric profile shown in FIG. 16 at reference 1040. In FIG. 16 (Nominal Bolt Configuration), a minimum contact area of 0.048 inches for a minimum tolerance fastener/maximum tolerance tool configuration, and a contact area of 0.061 inches for a minimum tolerance fastener/minimum tolerance tool configuration.

Figure 17:
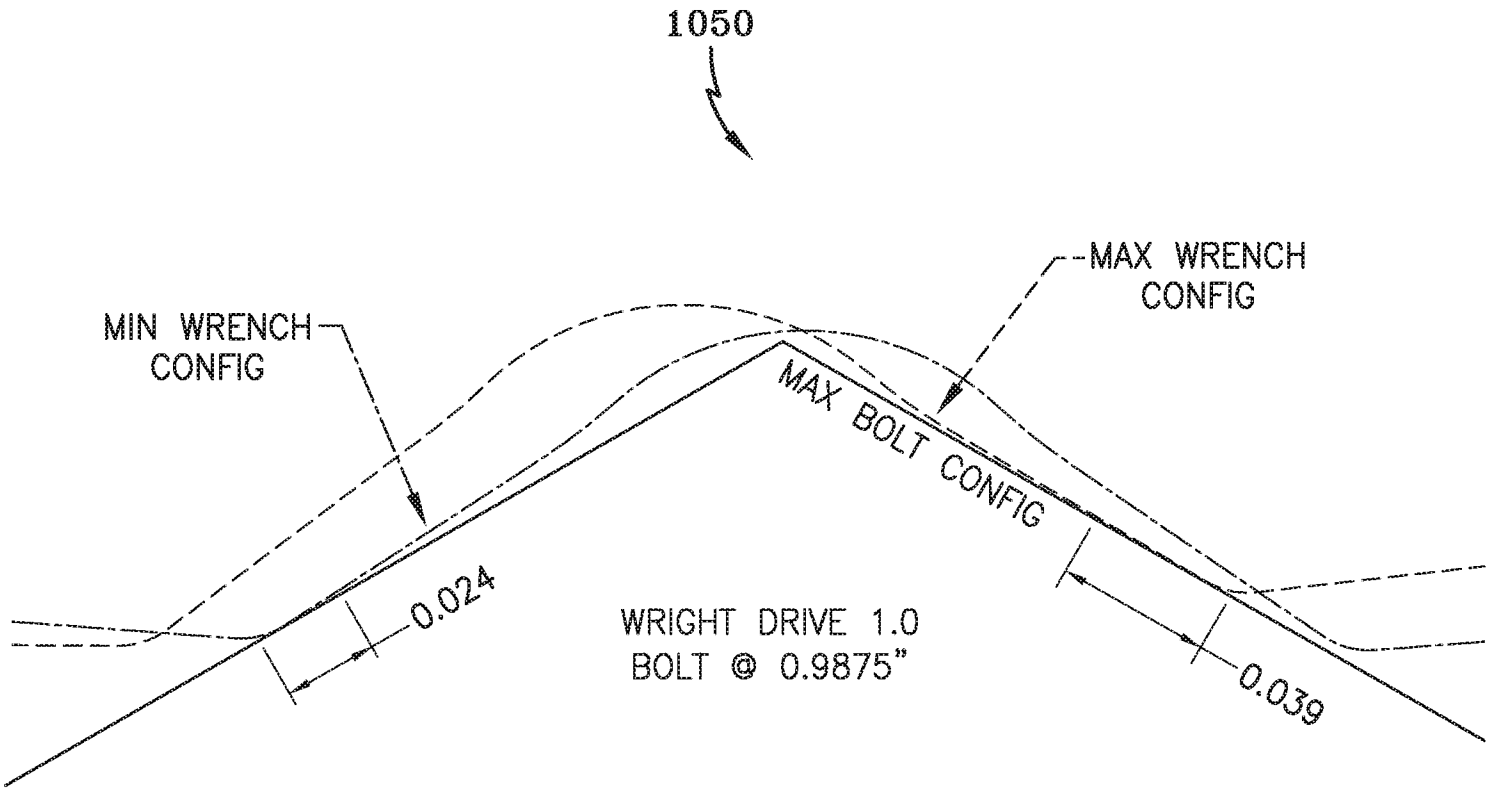
FIG-17 Prior Art
Figure 18:
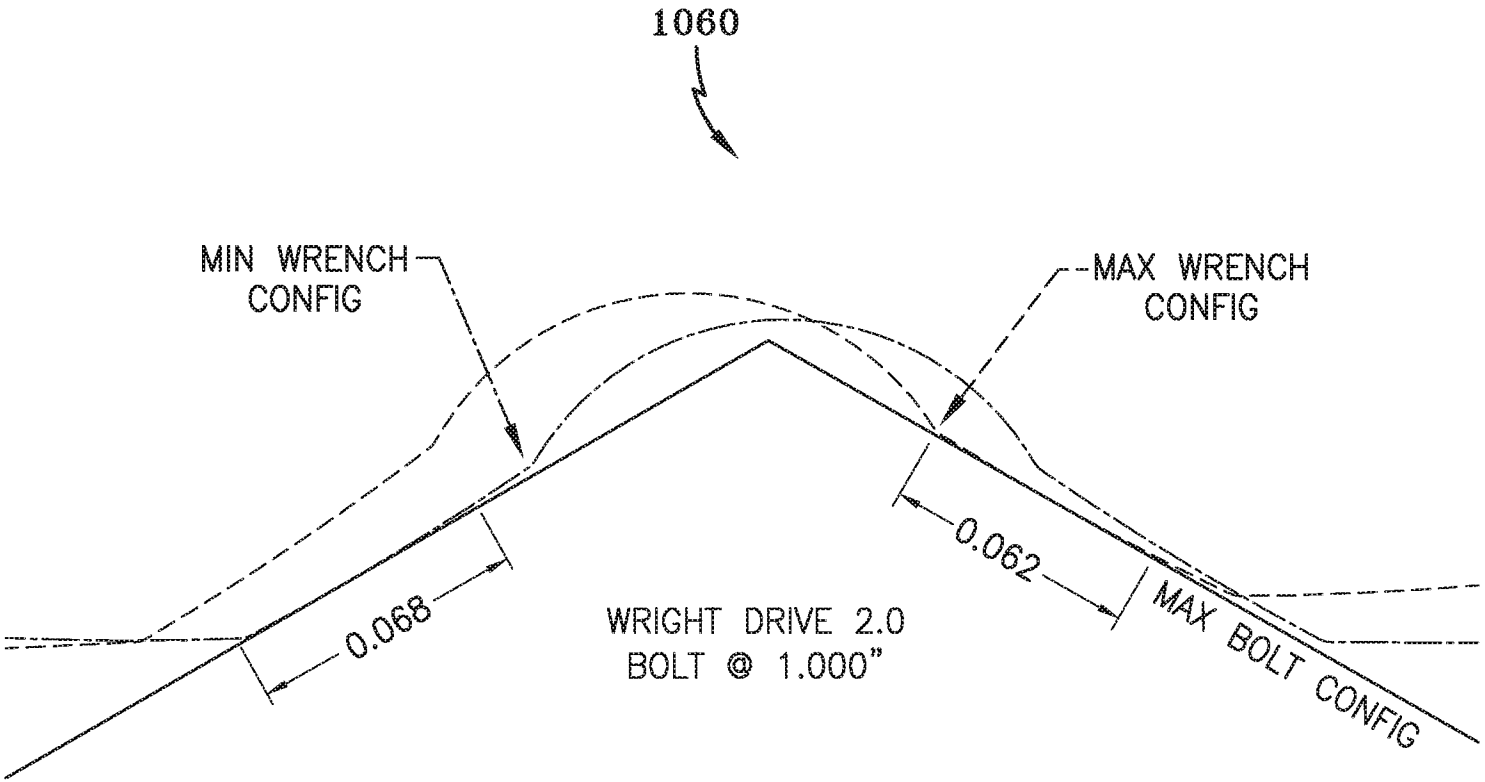

Turning now to FIGS. 17 and 18, disclosure of the improved landing area is explicated in an embodiment of a 12-point socket as shown at reference 1050 (FIG. 17). FIG. 17 (Maximum Bolt Configuration) exhibits a then state-of-the-art prior art fastening system comprising a particular 12-point fastening tool as disclosed in commonly owned U.S. Pat. No. 5,284,073 with a fastener configured to be at the minimal size per industry standard tolerances at reference 1050. The profile as per the prior art is shown at both a maximum tolerance tool profile and a minimum tolerance tool profile. It is to be appreciated that the maximum difference, and thus minimum contact area is to be generally generated at a condition of maximum tolerance for the tool and minimum tolerance for the fastener. As shown in FIG. 17, the prior art provides a minimum contact area of 0.039 inches for a minimum tolerance fastener/maximum tolerance tool configuration, and a contact area of 0.024 inches for a minimum tolerance fastener/minimum tolerance tool configuration. This contrasts with the fully parametric profile shown in FIG. 18 at reference 1060. In FIG. 18 (Maximum Bolt Configuration), a minimum contact area of 0.062 inches for a minimum tolerance fastener/maximum tolerance tool configuration, and a contact area of 0.068 inches for a minimum tolerance fastener/minimum tolerance tool configuration. This represents a respective advantage over the prior art of 2.8 to 1 and 1.6 to 1.

It is to be appreciated that while the Dossier (U.S. Pat. No. 4,581,957) reference may include some parametrization, the Dossier reference does not teach or go far enough. For example, the Table in Dossier provides for a constantly changing R2 (and changing X dimension of the face flat transition point to R2) based on different spans of actual tolerances, instead of teaching to a set standard maximum tolerance range (as may be dictated by industry standards), or a fully parametric profile. Dossier also does not recognize that its profile may be substantially affected by a choice of R1 (i.e., pocket radius). The present innovation not only recognizes these limitations, but advances parametrization to encompass a full profile, without holding back and limiting to situations that may not include tolerance or tolerance effects.

Thus, the disclosed innovation provides a fully parametric profile for a tool opening design which avoids contact with most any fastener corner that would produce high stress concentrations. In addition, the disclosed innovation provides a fully parametric profile for a tool opening design wherein the corner clearance recesses avoid sharp surfaces by providing parametrically controlled transitions from rounded corner pockets, to rounded driving surfaces to flat portions of the profile further reducing stress concentrations.

The disclosed innovation has been described with respect to a preferred embodiment. Modifications and alterations will occur to others upon the reading and understanding of this specification. It is intended that all such modifications and alterations be included insofar as they come within the scope of the patent as claimed or the equivalence thereof.

Having thus described the invention, the following is claimed:

1. A profile for a fastening tool for turning a fastener, the fastener having a central axis and a plurality of flat bounding surfaces spaced from the central axis with diametrically opposed pairs of flat bounding surfaces being parallel to each other, one of the plurality of flat bounding surfaces being demarcated at a constant "Y" Cartesian dimension, and the flat bounding surfaces of the fastener meeting to form fastener corners, said profile for the fastening tool having the central axis and comprising:

a plurality of uniformly spaced sides disposed peripherally and radially about said central axis, said sides being equal in number to the number of flat bounding surfaces of the fastener to be turned and diametrically opposed sides being generally parallel;

wherein a distance between the uniformly spaced sides is defined as a Wright number as measured by a face to face distance;

a plurality of corners between each sequential side disposed uniformly, peripherally and radially about said central axis, wherein each corner of the plurality of corners is parametrically sized from the Wright number to accept a fastener corner, each corner of the plurality of corners having a radius of curvature of approximately 0.071 multiplied by the Wright number and for a first corner of the plurality of corners having a center located symmetrically and parametrically about the center of the central axis typified by a first center located at an "X" Cartesian dimension of 0.254 multiplied by the Wright number and an "Y" Cartesian dimension of 0.441 multiplied by the Wright number, and respective subsequent corners of the plurality of corners placed equi-radially about the center of the central axis; and each uniformly spaced sides adjoining the plurality of corners transition symmetrically and parametrically about the center of the first and respective subsequent corners typified for the first corner of the plurality of corners by a first transition at a combined tangent point of the radius of curvature of the corner to a second radius, said second radius parametrically sized to be 0.209 multiplied by the Wright number, and said combined tangent point typified to be parametrically sized to be located at a "X" Cartesian dimension of 0.234 multiplied by the Wright number, and a second transition at a second tangent of the second radius to the uniformly spaced side typified at a "X" Cartesian dimension of 0.173 multiplied by the Wright number, and respective subsequent corners of the plurality of corners placed equi-radially about the center of the central axis.

2. A profile for a fastening tool for turning a fastener, the fastener having a central axis and a plurality of flat bounding surfaces spaced from the central axis with diametrically opposed pairs of flat bounding surfaces being parallel to each other, one of the plurality of flat bounding surfaces being demarcated at a constant "Y" Cartesian dimension, and the flat bounding surfaces of the fastener meeting to form fastener corners, said profile for the fastening tool having the central axis and consisting of:

a plurality of uniformly spaced sides disposed peripherally and radially about said central axis, said sides being equal in number to the number of flat bounding surfaces of the fastener to be turned and diametrically opposed sides being generally parallel;

wherein a distance between the uniformly spaced sides is defined as a Wright number as measured by a face to face distance;

a plurality of corners between each sequential side disposed uniformly, peripherally and radially about said central axis, wherein each corner of the plurality of corners is parametrically sized from the Wright number to accept a fastener corner, each corner of the plurality of corners having a radius of curvature of approximately 0.071 multiplied by the Wright number and for a first corner of the plurality of corners having a center located symmetrically and parametrically about the center of the central axis typified by a first center located at an "X" Cartesian dimension of 0.254 multiplied by the Wright number and an "Y" Cartesian dimension of 0.441 multiplied by the Wright number, and respective subsequent corners of the plurality of corners placed equi-radially about the center of the central axis; and each uniformly spaced sides adjoining the plurality of corners transition symmetrically and parametrically about the center of the first and respective subsequent corners typified for the first corner of the plurality of corners by a first transition at a combined tangent point of the radius of curvature of the corner to a second radius, said second radius parametrically sized to be 0.209 multiplied by the Wright number, and said combined tangent point typified to be parametrically sized to be located at a "X" Cartesian dimension of 0.234 multiplied by the Wright number, and a second transition at a second tangent of the second radius to the uniformly spaced side typified at a "X" Cartesian dimension of 0.173 multiplied by the Wright number, and respective subsequent corners of the plurality of corners placed equi-radially about the center of the central axis.

3. A system of fastening tools, wherein each of a plurality of fastening tools of the system of fastening tools is configured to provide a fully parametric working profile for each of the plurality of fastening tool, the configuration comprising:

a central axis and a plurality of flat bounding surfaces spaced from, and disposed peripherally and radially about the central axis with diametrically opposed pairs of flat bounding surfaces being parallel to each other, said flat bounding surfaces being equal in number to a number of sides of a fastener to be turned;

one of the plurality of flat bounding surfaces being demarcated at a constant "Y" Cartesian dimension;

wherein a distance between the diametrically opposed pairs of flat bounding surfaces is defined as a Wright number;

the flat bounding surfaces meeting to form a plurality of corners;

the plurality of corners between each sequential flat bounding surface disposed uniformly, peripherally and radially about said central axis, wherein each corner of the plurality of corners is parametrically sized from the Wright number to accept a fastener corner, each corner of the plurality of corners having a radius of curvature of approximately 0.071 multiplied by the Wright number and for a first corner of the plurality of corners having a center located symmetrically and parametrically about the center of the central axis typified by a first center located at an "X" Cartesian dimension of 0.254 multiplied by the Wright number and an "Y" Cartesian dimension of 0.441 multiplied by the Wright number, and respective subsequent corners of the plurality of corners placed equi-radially about the center of the central axis;

each flat bounding surface adjoining the plurality of corners transitions symmetrically and parametrically about the center of the first and respective subsequent corners typified for the first corner of the plurality of corners by a first transition at a combined tangent point of the radius of curvature of the first corner to a second radius, said second radius parametrically sized to be 0.209 multiplied by the Wright number, and said combined tangent point typified to be parametrically sized to be located at a "X" Cartesian dimension of 0.234 multiplied by the Wright number, and a second transition at a second tangent of the second radius to the flat bounding surface typified at a "X" Cartesian dimension of 0.173 multiplied by the Wright number, and respective subsequent corners of the plurality of corners placed equi-radially about the center of the central axis; and wherein for the system, each of a plurality of predetermined Wright numbers defines the fully parametric working profile of each fastening tool of the system.

4. The system of claim 3, wherein the plurality of predetermined Wright numbers are based on $\alpha W$.

5. The system of claim 4, wherein $\alpha$ is determined in relation to variables comprising one or more of material of tool, material of fastener, and present coatings.

6. The system of claim 3, wherein said flat bounding surfaces being equal in number to an integer multiple number of sides of a fastener to be turned.

* * * * *